US005339474A

United States Patent [19]

Kim et al.

[11] Patent Number: 5,339,474

[45] Date of Patent: Aug. 23, 1994

[54] APPARATUS FOR AND METHOD OF DETERMINING TWIST OF CLOTHES BEING WASHED IN WASHER

[75] Inventors: Jung H. Kim, Seoul; Hyung S. Kim, Kyungki-Do; Byeong H. Lee, Kyungki-Do; Young H. Roh, Kyungki-Do; Hae Y. Chung, Seoul, all of Rep. of Korea

[73] Assignee: Goldstar Co., Ltd., Rep. of Korea

[21] Appl. No.: 132,462

[22] Filed: Oct. 6, 1993

[30] Foreign Application Priority Data

Jun. 19, 1993 [KR] Rep. of Korea ..... 11229/1993

[51] Int. Cl.[5] ..... D06F 33/02

[52] U.S. Cl. ..... 8/159; 68/12.02; 68/12.27

[58] Field of Search ..... 8/159; 68/12.01, 12.02, 68/12.04, 12.27

[56] References Cited

U.S. PATENT DOCUMENTS

| | | | |
|---|---|---|---|
| 5,072,473 | 12/1991 | Thuruta et al. | 8/159 |
| 5,144,819 | 9/1992 | Hiyama et al. | 68/12.04 |
| 5,161,393 | 11/1992 | Payne et al. | 68/12.04 |
| 5,208,931 | 5/1993 | Williams et al. | 8/159 |
| 5,230,228 | 7/1993 | Nakano et al. | 68/12.02 X |

FOREIGN PATENT DOCUMENTS

| | | | |
|---|---|---|---|
| 49786 | 3/1993 | Japan | 68/12.02 |

*Primary Examiner*—Philip R. Coe

*Attorney, Agent, or Firm*—Ostrolenk, Faber, Gerb & Soffen

[57] ABSTRACT

An apparatus for and a method of determining a twist of clothes being washed in a washer, wherein a sensing signal indicative of the twist of clothes is analyzed, to determine whether the clothes twist signal is a meaningful signal or a noise, so that when the clothes twist signal is the meaningful signal, an operation in a clothes untwisting mode is carried out for minimizing a damage of the clothes. The apparatus includes a clothes twist sensing unit for sensing a torque occurring at a drive shaft due to the distribution of impact applied to an agitator and generating a clothes twist signal according to the sensed torque, a correlation coefficient operating unit for converting the clothes twist signal into a digital signal indicative of a state value of the clothes twist signal, analyzing the state value of the clothes twist signal, and operating a correlation coefficient to be used for determining whether the clothes twist signal is a meaningful signal or a noise, based on the analysis, and a microprocessor for performing a control for executing a clothes untwisting mode, when the clothes twist signal is the meaningful signal, from the correlation coefficient outputted from the correlation coefficient operating unit.

9 Claims, 8 Drawing Sheets

APPARATUS FOR AND METHOD OF DETERMINING TWIST OF CLOTHES BEING WASHED IN WASHER

BACKGROUND OF THE INVENTION

1. Field of the Invention

The present invention relates to a washer, and more particularly to an apparatus for and a method of determining a twist of clothes being washed in a washer.

2. Description of the Prior Art

In general washers, a clothes twist signal indicative of a twist of clothes being washed is obtained, based on an experimental measurement. Using such a clothes twist signal, a clothes untwisting mode is carried out, to reduce a phenomenon that clothes become twisted. Otherwise, washers have conventionally used an agitator having a construction changed for reducing the clothes twist phenomenon.

Where clothes are distributed in a washer without a twist, as shown in FIG. 1, an agitator receives uniform impact from the clothes being washed when it is rotated by a rotation force of a motor.

However, when the clothes are twisted, as shown in FIG. 2, the impact applied to the agitator by the clothes becomes higher locally at a portion of the agitator coming into contact with the twisted portion of the clothes. As a result, the twisted cloths of the clothes may be damaged. Furthermore, the washed degree of clothes becomes lowered, because the twisted cloths are hardly washed.

For solving this problem, conventional washers generate a clothes twist signal by sensing a twist of clothes according to the quantity of clothes, the kind of clothes, and a water flow sensing signal when operations in a washing mode and a rinsing mode are carried out. However, it is impossible to determine whether the generated clothes twist signal is a meaningful signal or a noise, because the clothes twist signal has a complexity. As a result, cloths of the clothes may be damaged when operations in the washing mode and the rinsing mode are continued under a condition that the clothes has been twisted, due to an erroneous determination for the clothes twist signal. Moreover, there is a problem that the washing degree is degraded at the twisted portion of clothes.

SUMMARY OF THE INVENTION

Therefore, an object of the invention is to provide an apparatus for and a method of determining a twist of clothes being washed in a washer, wherein a sensing signal indicative of the twist of clothes is analyzed, to determine whether the clothes twist signal is a meaningful signal or a noise, so that when the clothes twist signal is the meaningful signal, an operation in a clothes untwisting mode is carried out for minimizing a damage of the clothes and thus operations in a washing mode and a rinsing mode are carried out without generating the twist of clothes, thereby improving the washing degree.

In accordance with one aspect, the present invention provides an apparatus for determining a twist of clothes being washed in a washer, comprising: clothes twist sensing means for sensing a torque occurring at a drive shaft of said washer due to the twist of clothes, to sense the distribution of impact applied to an agitator of the washer by said clothes, and generating a clothes twist signal according to the sensed impact distribution; correlation coefficient operating means for converting said clothes twist signal into a digital signal indicative of a state value of the clothes twist signal, analyzing said state value of the clothes twist signal, and operating a correlation coefficient to be used for determining whether the clothes twist signal is a meaningful signal or a noise, based on the analysis; and a microprocessor for performing a control for executing a clothes untwisting mode, when the clothes twist signal is determined to be said meaningful signal, from said correlation coefficient outputted from said correlation coefficient operating means.

In accordance with another aspect, the present invention provides a method of determining a twist of clothes being washed in a washer, comprising the steps of: (a) determining whether the current mode of said washer is a washing mode or a rinsing mode; (b) agitating said clothes normally and reversely for a predetermined time by driving a motor and an agitator equipped in the washer, sensing a torque occurring at a drive shaft of the washer due to an impact from the clothes, and generating a clothes twist signal according to the sensed torque; (c) operating a correlation coefficient of said clothes twist signal outputted at said step (b), to determine whether the clothes twist signal is a meaningful signal or a noise; and (d) comparing the correlation coefficient outputted at said step (c) with the reference value, executing the clothes untwisting mode when the correlation coefficient is higher than the reference value, determining whether the current mode has been completed when the correlation coefficient is not higher than the reference value, and repeating the steps following said first step (a) when the current mode has not been completed yet.

In accordance with the present invention, a twist of clothes is sensed from the distribution of impact applied to the agitator by the clothes. A sensing signal indicative of the twist of clothes is analyzed. When the clothes twist signal is determined to be a meaningful signal, based on the result of the analysis, the clothes twist signal is compared with a reference value. Where the clothes twist signal is higher than the reference value, a clothes untwisting mode is executed. Accordingly, it is possible to execute the washing mode and the rinsing mode without any twist of clothes, and thus to minimize a damage of clothes occurring at the twisted portion of clothes and improve the washing degree degraded at the twisted portion of clothes.

BRIEF DESCRIPTION OF THE DRAWINGS

The various features and advantages of the present invention may be more readily understood with reference to the following detailed description taken in conjunction with the accompanying drawings in which.

DETAILED DESCRIPTION OF THE PREFERRED EMBODIMENTS

Figure 1:
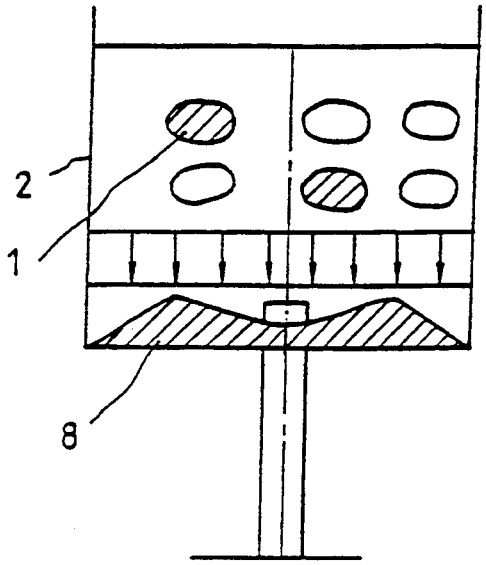
FIG. 1 PRIOR ART
FIG. 1 is a schematic sectional view of a washer, illustrating a condition that clothes are distributed in a washing tub without any twist.
Figure 2:
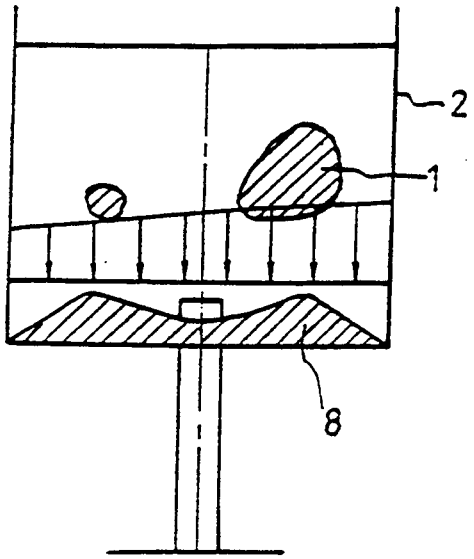
FIG. 2 PRIOR ART
FIG. 2 is a schematic sectional view of a washer, illustrating a twisted condition of clothes in a washing tub.
Figure 3:
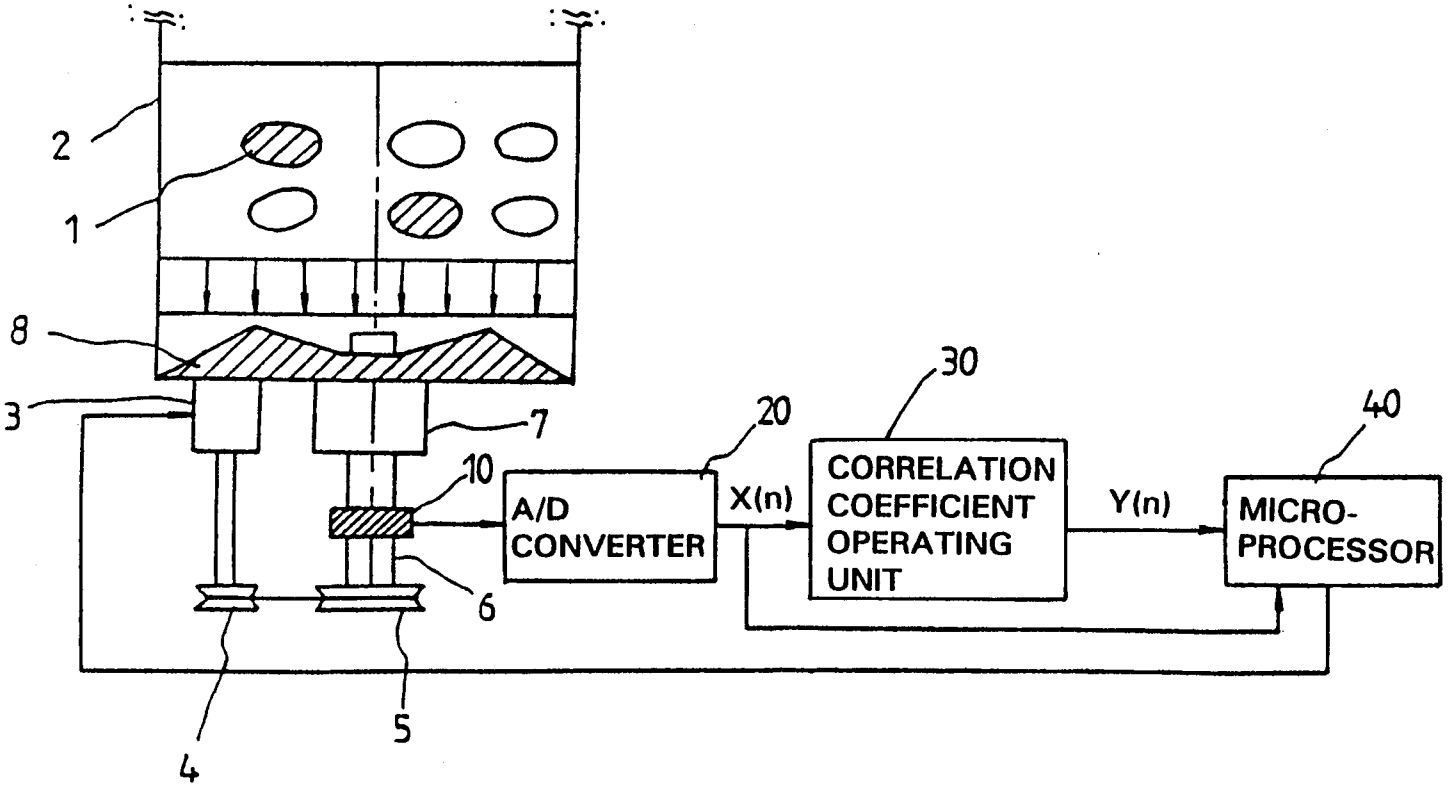
FIG. 3 is a schematic sectional view of a washer to which the present invention is applied, the view also illustrating a clothes twist determining apparatus of the present invention by a block diagram.

Referring to FIG. 3, there is schematically illustrated a washer to which the present invention is applied. In FIG. 3, a clothes twist determining apparatus of the present invention is shown by a block diagram.

As shown in FIG. 3, the washer comprises a washing tub 2 for washing clothes 1 contained therein, with a double structure including a dehydrating tub 11 and an outer tub 12. The washer also comprises a pulley 4 mounted on a rotation shaft of a motor 3 and adapted to receive a rotation force from the motor 3, a pulley 5 connected to the pulley 4 via a belt and adapted to receive the rotation force of motor 3 from the pulley 4 via the belt, and a drive shaft 6 coupled at its lower end to the pulley 5 and adapted to be rotated by the rotation force of motor 3 transmitted by the pulley 5. A clutch 7 is coupled to the upper end of drive shaft 6, to receive the rotation force of motor 3 from the drive shaft 6. Above the clutch 7, an agitator 8 is disposed in the washing tub 2. The agitator 8 receives the rotation force of motor 3 from the clutch 7 and rotates normally and reversely by the received rotation force.

In accordance with the present invention, the clothes twist determining apparatus comprises a clothes twist sensing unit 10 for sensing a torque occurring at the drive shaft 6 due to the distribution of impact applied to the agitator 8 and generating a clothes twist signal according to the sensed torque. The clothes twist sensing unit 10 is disposed at a middle portion of the drive shaft 6. To the output of the clothes twist sensing unit 10, an A/D converter 20 is connected, which converts the clothes twist signal outputted from the clothes twist sensing unit 10 into a digital signal and outputs a state value X(n) of the clothes twist signal. A correlation coefficient operating unit 30 is connected the output of the A/D converter 20. The correlation coefficient operating unit 30 is adapted to receive the state value X(n) of clothes twist signal from the A/D converter 20 and derive a clothes twist signal correlation coefficient Y(n) to be used for determining whether the clothes twist signal is a meaningful signal, from the received state value X(n) of clothes twist signal. The clothes twist determining apparatus also comprises a microprocessor 40 coupled to the output of the correlation coefficient operating unit 30 and adapted to compare the correlation coefficient Y(n) with a reference value previously stored therein and control an execution of a clothes untwisting mode when the correlation coefficient Y(n) is higher than the reference value.

Figure 4:
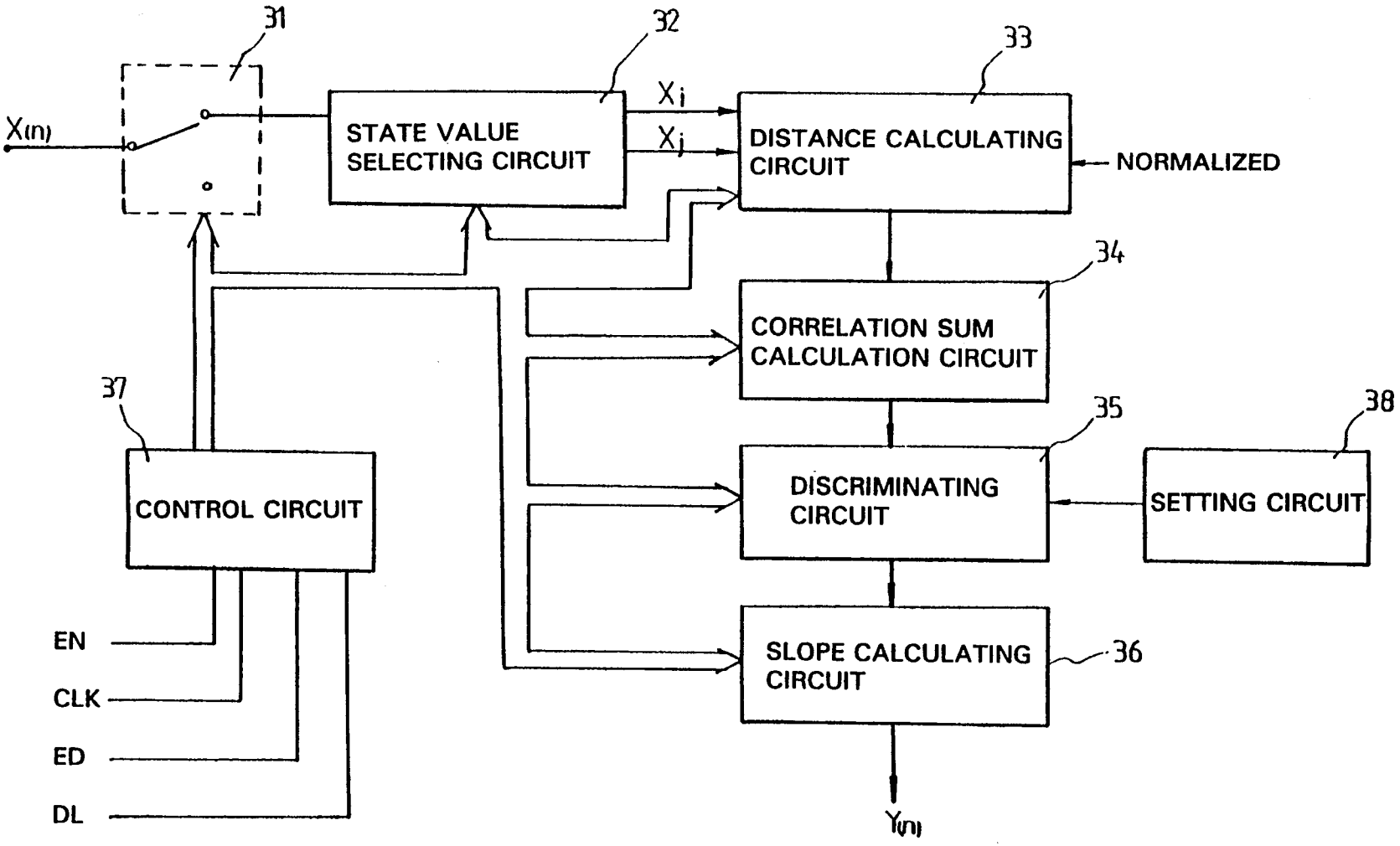
FIG. 4 is a block diagram of a correlation coefficient operating unit employed in the clothes twist determining apparatus in accordance with the present invention.

The clothes twist sensing unit 10 comprises a vibration sensor which serves to convert the torque of the drive shaft 6 into an electrical signal. As shown in FIG. 4, the correlation coefficient operating unit 30 comprises a switching circuit 81 adapted to switch state values X(n) of the clothes twist signal, which are to be analyzed, sequentially with the lapse of time and to output them, a state value selecting circuit 32 adapted to select state values outputted from the switching circuit 31, based on an embedding dimension ED and a delay time DL, and a distance calculating circuit 33 adapted to calculate a distance Rij based on two state values Xi and Xj selected in the state value selecting circuit 32 and to output the distance Rij. A correlation sum calculating circuit 34 is also provided, which is adapted to compare the distance Rij outputted from the distance calculating circuit 33 with a previously stored distance index di and output a correlation sum C(r) corresponding to the distance index which meets a given distance condition. The correlation coefficient operating unit 30 also comprises an inflection point discriminating circuit 35 adapted to discriminate suitable inflection points of the correlation sum C(r) outputted from the correlation sum calculating circuit 34, a slope calculating circuit 36 adapted to calculate a slope of a line connecting the inflection points outputted from the inflection point discriminating circuit 35 and output the correlation coefficient Y(n), and a control circuit 37 adapted to output control signals for controlling the switching circuit 31, the state value selecting circuit 32, the distance calculating circuit 33, the correlation sum calculating circuit 34 and the discriminating circuit 35, based on an input clock CLK, an enable signal EN, the embedding dimension ED and the delay time DL.

The state value selecting circuit 32 includes a pair of registers. A setting circuit 38 is connected to the other input of the discriminating circuit 35, so as to input an optimum inflection point from outside at the discriminating circuit 35.

Figure 6:
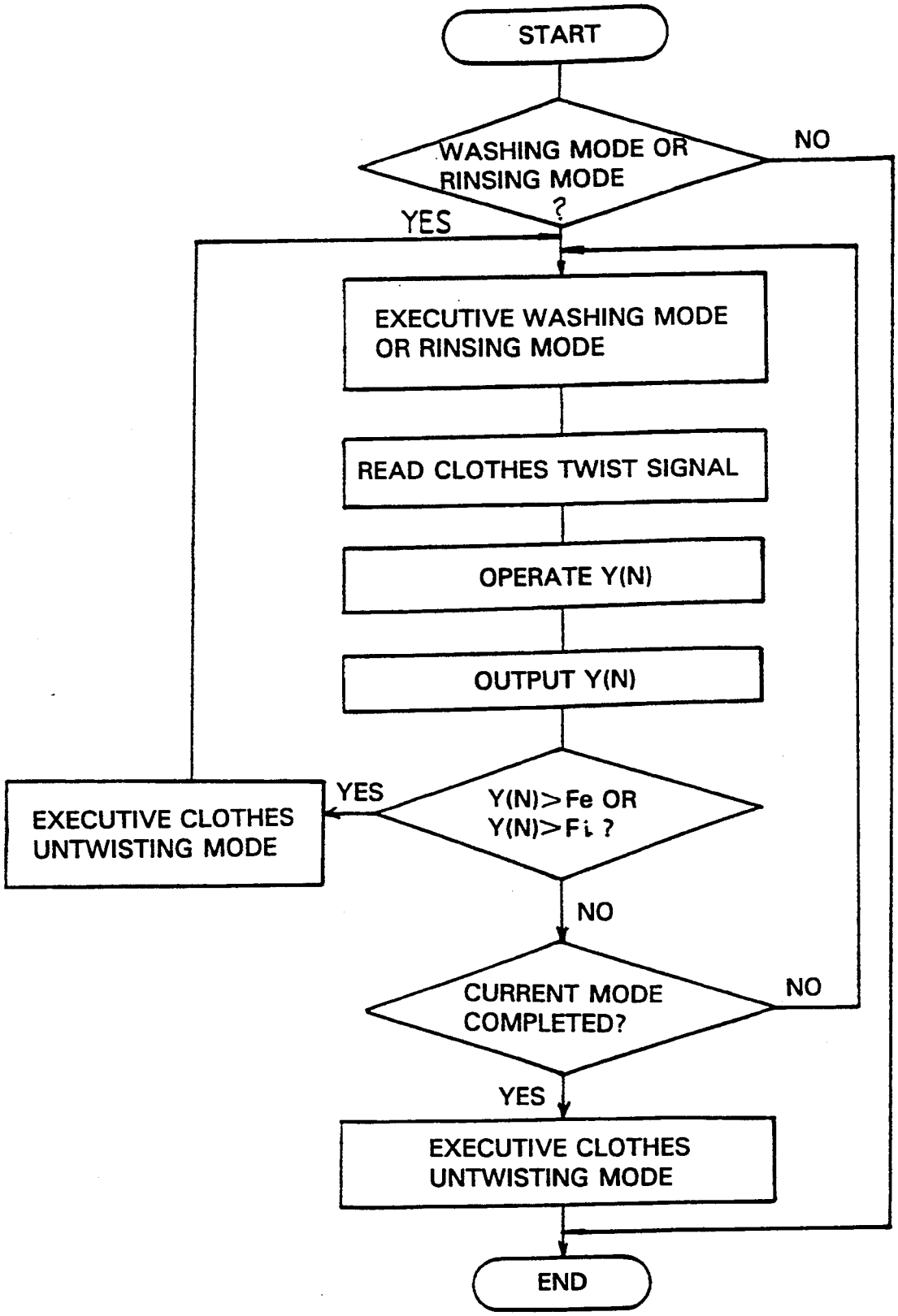
FIG. 6 is a flow chart illustrating a first embodiment of the clothes twist determining method in accordance with the present invention.

Referring to FIG. 6, there is illustrated a method of determining the twist of clothes being washed in the washer by use of the above-mentioned clothes twist determining apparatus, in accordance with the present invention. This method comprises a first procedure of determining whether the current mode of the washer is the washing mode or the rinsing mode, and a second procedure of agitating clothes normally and reversely for a predetermined time by driving the motor 3, sensing a torque occurring at the drive shaft 6 due to the distribution of impact applied to the agitator 8 and generating a clothes twist signal according to the sensed torque. The method also comprises a third procedure of receiving the clothes twist signal outputted at the second procedure and operating a correlation coefficient of the clothes twist signal, to determine whether the clothes twist signal is a meaningful signal or a noise, and a fourth procedure of comparing the correlation coefficient outputted at the third procedure with the reference value, executing the clothes untwisting mode when the correlation coefficient is higher than the reference value, determining whether the current mode has been completed when the correlation coefficient is not higher than the reference value, and repeating the procedures following the first procedure when the current mode has not been completed yet.

Functions and effects of the clothes twist determining apparatus and method will now be described, in conjunction with the annexed drawings.

When a washing mode is selected after clothes 1 to be washed have been poured in the washing tub 2, a predetermined amount of washing water is supplied in the washing tub 2.

As the motor 3 is then driven for a predetermined time, a rotation force generated from the motor 3 is transmitted to the drive shaft 6 via the pulleys 4 and 5 and then applied to the agitator 8 via the clutch 7, thereby causing the agitator 8 to rotate normally and reversely.

The normal rotation time and the reverse rotation time of the agitator 8 are set to be identical to each other. Also, the stop time after the normal rotation of agitator 8 and the stop time after the reverse rotation of agitator 8 are shorter than the normal rotation time and the reverse rotation time, respectively.

By the normal and reverse rotations of the agitator 8, the clothes 1 are agitated normally and reversely. The clothes 1 being agitated strike against the agitator 8, so that the agitator 8 is subjected to an impact.

Where cloths of the clothes 1 being agitated have been twisted, an impact applied to the agitator 8 by the twisted portion of the clothes 1 becomes higher than an impact applied to the agitator 8 by the clothes portion not twisted. The impact effects on the drive shaft 6, so that the torque of drive shaft 6 becomes varied, The torque of drive shaft 6 is converted into an electrical signal by the clothes twist sensing unit 10. Thus, a clothes twist signal is generated. The clothes twist signal has a complexity that becomes higher in clothes including more various cloths. First, such a complex clothes twist signal should be analyzed, to determine whether the clothes twist signal is a meaningful signal or a noise.

For achieving the analysis, the clothes twist signal is applied to the A/D converter 20 which, in turn, converts the clothes twist signal into a digital signal and thus outputs a state value X(n) of the clothes twist signal.

The state value X(n) of clothes twist signal is applied to the correlation coefficient operating unit 30 and selected, based on a given embedding dimension ED and a delay time DL.

This procedure will be described in conjunction with an example of an embedding dimension ED=1 and a delay time $DL=\Delta=\tau t$.

A state value X(n) of an input clothes twist signal is applied to the state selecting circuit 32 through the switching circuit 31 which performs its switching operation according to a control signal from the control circuit 37.

Assuming that an initial value of the inputted state X(n) is X(t0), the initial state value X(t0) is fed to the state selecting circuit 32 through the switching circuit 31. State values which are continuously inputted one by one at every delay timer $\tau$ are applied to the state selecting circuit 32 through the switching circuit 31.

Namely, the initial state value X(t0) is first inputted at the state selecting circuit 32. Then, the state selecting circuit 32 receives a state value $X(t0+\Delta t)$ at the delay time $t0+\Delta t$. The state values X(t0) and $X(t0+\Delta t)$ are then applied to the distance calculating circuit 33 according to a control signal from the control circuit 37.

The distance calculating circuit 33 stores the inputted state values X(t0) and $X(t0+\Delta t)$ in its registers, respectively, for a predetermined time and then outputs them as state values with the lapse of time.

With the outputted state values X(t0) and $X(t0+\alpha t)$, the distance calculating circuit 33 calculates a distance R11 between the two state values X(t0) and $X(t0+\Delta t)$. At this time, the embedding dimension ED is 1 and the delay time $\tau$ is $\Delta t$. Accordingly, the distance R11 can be obtained from an operation using the following equation:

$$R11=|X(t0)-X(t0+\Delta t)|.$$

The calculated distance R11 is outputted under a condition that it has been normalized by a maximum value Dmax, a minimum value Dmin or other values, all of the values being optionally predetermined.

The distance R11 is then applied to the correlation sum calculating circuit 34 which, in turn, compares the inputted distance R11 with the previously stored distance index di and increments the distance index di by one when the condition of R11>di is satisfied, to obtain an incremented distance index dj.

Namely, the incremented distance index dj satisfies the following equation (2 ):

$$dj=di+1 \quad (2).$$

The above procedure is performed for the delay time $\Delta t$. The switching circuit 31 supplies a state value $X(t0+2\Delta t)$ received therein at the next delay time $2\Delta t$. Based on the inputted state value $X(t0+2\Delta t)$ and the initial state value X(t0), the distance calculating circuit 33 outputs a distance R12 between the two state values.

The outputted distance R12 is compared with the previously stored distance index dj through the correlation sum calculating circuit 34. When the compared result satisfies the condition of R12>dj, the distance index dj is incremented.

The above procedures are repeated with respect to all state values received with the lapse of delay time. When the number of states Ndj, which is present in a circle having a diameter corresponding to the incremented distance index, reaches the predetermined final number Dmax, no input state value is applied to the state value selecting circuit 32 via the switching circuit 31.

Namely, in such a case that the number of states Ndj present in the circle having the diameter which corresponds to the distance index dj has been determined to reach the final number Dmax through the correlation sum calculating circuit 34, a control signal is supplied from the control circuit 37 to the switching circuit 31 so that the switching circuit 31 performs its switching operation. By the switching operation of switching circuit 31, the supplying of state value to the state value selecting circuit 32 is shut off.

In the mean while, the discriminating circuit 35 receives a control signal from the control circuit 37 and selects the distance indexes di and dj having a suitable inflection point in a graph which represents the number of states Ndj present in the circle having the diameter corresponding to the inputted distance index.

The inflection point may be selected as the distance indexes di and dj previously set in the discriminating circuit 35. Otherwise, the user may set the inflection point through the setting circuit 38 at outside.

Where distance indexes have been previously set through the discriminating circuit 35, in order to derive the inflection point, a distance index is selected from optional distance indexes di and dj. A search is made for a distance index which satisfies the minimum distance from a line connecting the selected distance index and the other distance index. Once the distance index is found, a procedure for setting the found distance index as the inflection point is performed to determine a suitable inflection point. Where the distance index is determined by the setting circuit 38, an optimum inflection point derived experimentally is determined from outside.

The inflection point determined as above is fed to the slope calculating circuit 36. Where an X–Y coordinate plane is made by an axis d-axis indicative of the distance index and an axis Nd indicative of the number of state values being present in a circle with a diameter equivalent to the distance index, the slope calculating circuit 36 calculates a slope resulted from the incremented number of state values.

At this time, the slope is calculated by using the following equation (3):

$$\text{Slope}=[\log(Ndj)-\log(Ndi)]/[\log(dj)-\log(di)] \quad (3)$$

The calculated slope is the correlation coefficient, of clothes twist signal state values, namely, a final output Y (1) of the correlation coefficient operating unit 30.

The correlation coefficient of clothes twist signal state values, which is obtained on the assumption that the embedding dimension ED is 1, and the delay time DL is $\Delta t$, refers to as a correlation coefficient according to a pointwise method.

Where the embedding dimension ED and the delay time DL ($DL=\tau$) are assumed as n and $t\Delta p$, respectively, the state value selecting circuit 32 outputs state values Xi at the time t0 through the switching circuit 31 for the time $(n-1)p\Delta t$.

The state values can be expressed by the following equation:

$$Xi=[X(t0), X(t0+p\Delta t), \ldots, X(t0+(n-1)p\Delta t)].$$

Also, the state values Xj at the time $t0+\Delta t$ can be expressed by the following equation:

$$Xj=[X(t0+\Delta t), X(t0+(p+1)\Delta t), \ldots, X(t0+np\Delta t)].$$

The distance value Rij calculated from the above state values is $|Xj-xi|$. Based on the calculated distance, the correlation dimension Y(n) of clothes twist state values can be obtained through the correlation calculating circuit 34, the discriminating circuit 35, the slope calculating circuit 36, and the control circuit 37.

Figure 5:
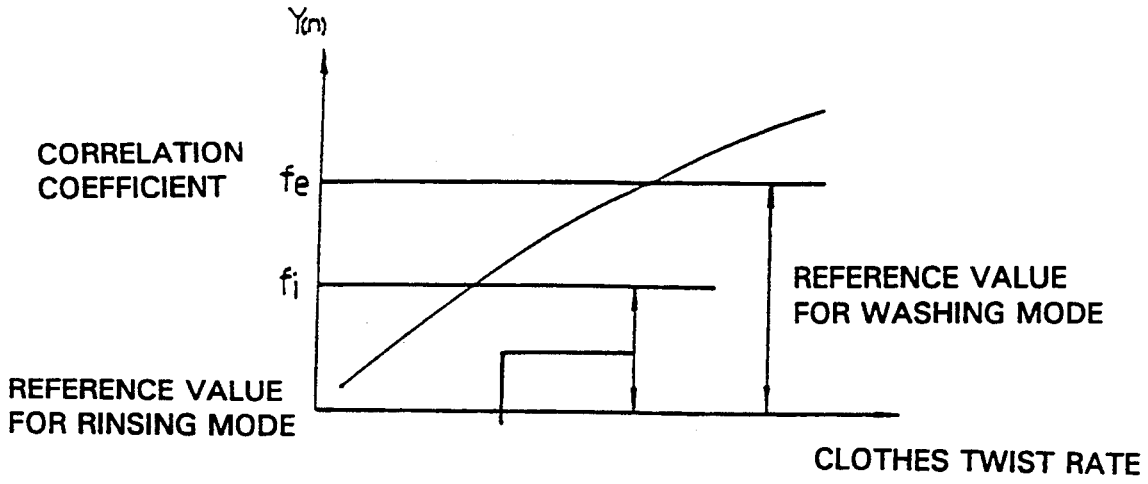
FIG. 5 is a graph illustrating correlation coefficients obtained in the clothes twist determining apparatus of the present invention.

FIG. 5 is a graph illustrating final correlation coefficients outputted from the correlation coefficient operating unit 30.

From the obtained correlation coefficient Y(n), a determination is made about whether the state value of input clothes twist signal is a clothes twist signal obtained from a meaningful signal or a clothes twist signal obtained from a noise.

The correlation coefficient Y(n) is applied to the microprocessor 40, so as to control the washing operation according to the state value of clothes twist signal received via the A/D converter 20.

That is, the microprocessor 40 compares the correlation coefficient Y(n) with the reference value stored therein. The reference value is set as Fe for the washing mode and as Fi for the rinsing mode. When the correlation coefficient Y(n) is higher than the reference value, the microprocessor 40 performs a control for executing the clothes untwisting mode. On the other hand, when the correlation coefficient Y(n) is not higher than the reference value, the microprocessor 40 performs a control for executing the current mode continuously.

The correlation coefficient Y(n) is used as information for controlling the washer during the executions of the washing mode, the rinsing mode, and the dehydrating mode.

Figure 8:
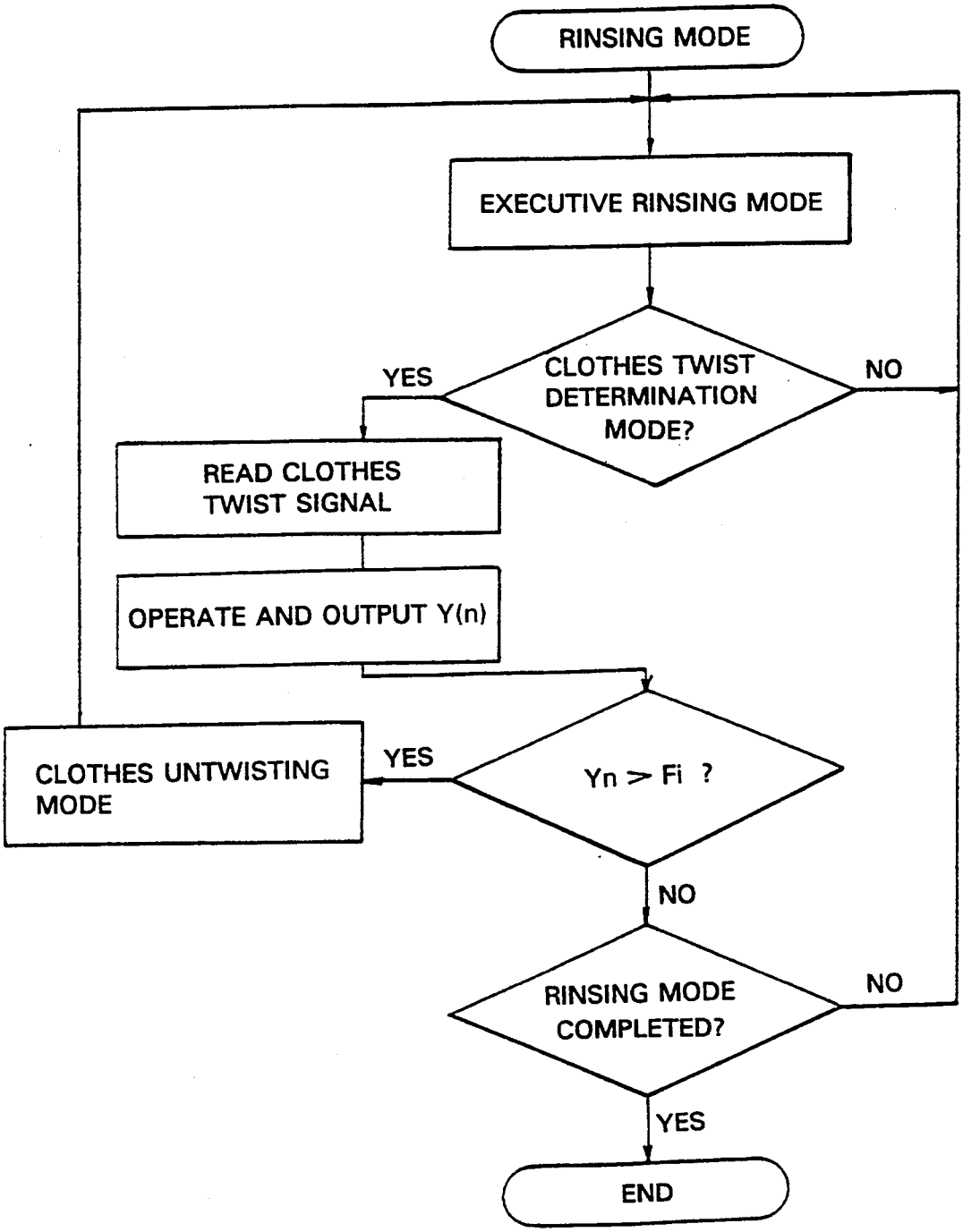
FIG. 8 is a flow chart illustrating a clothes twist determining procedure when a rinsing mode is executed in accordance with the first embodiment of the present invention.

FIG. 8 is a flow chart illustrating a first embodiment of the clothes twist determining method in accordance with the present invention. In accordance with this method, first, a determination is made about whether the current mode is the washing mode or the rinsing mode, as shown in FIG. 6. Thereafter, a clothes twist signal outputted from the clothes twist sensing unit 10 is read during the execution of the washing mode or the rinsing mode. The clothes twist signal is then analyzed so that its correlation coefficient Y(n) is operated.

Subsequently, the correlation coefficient Y(n) is compared with the reference value Fe of the washing mode or the reference value Fi of the rinsing mode. When the correlation coefficient Y(n) has been determined to be higher than the reference value Fe or Fi, the clothes untwisting mode is executed. When the correlation coefficient Y(n) is not higher than the reference value Fe or Fi, a determination is made about whether the current mode has been completed. When the current mode has been completed, the clothes untwisting mode is executed. If not, the current mode is continuously executed.

Figure 7:
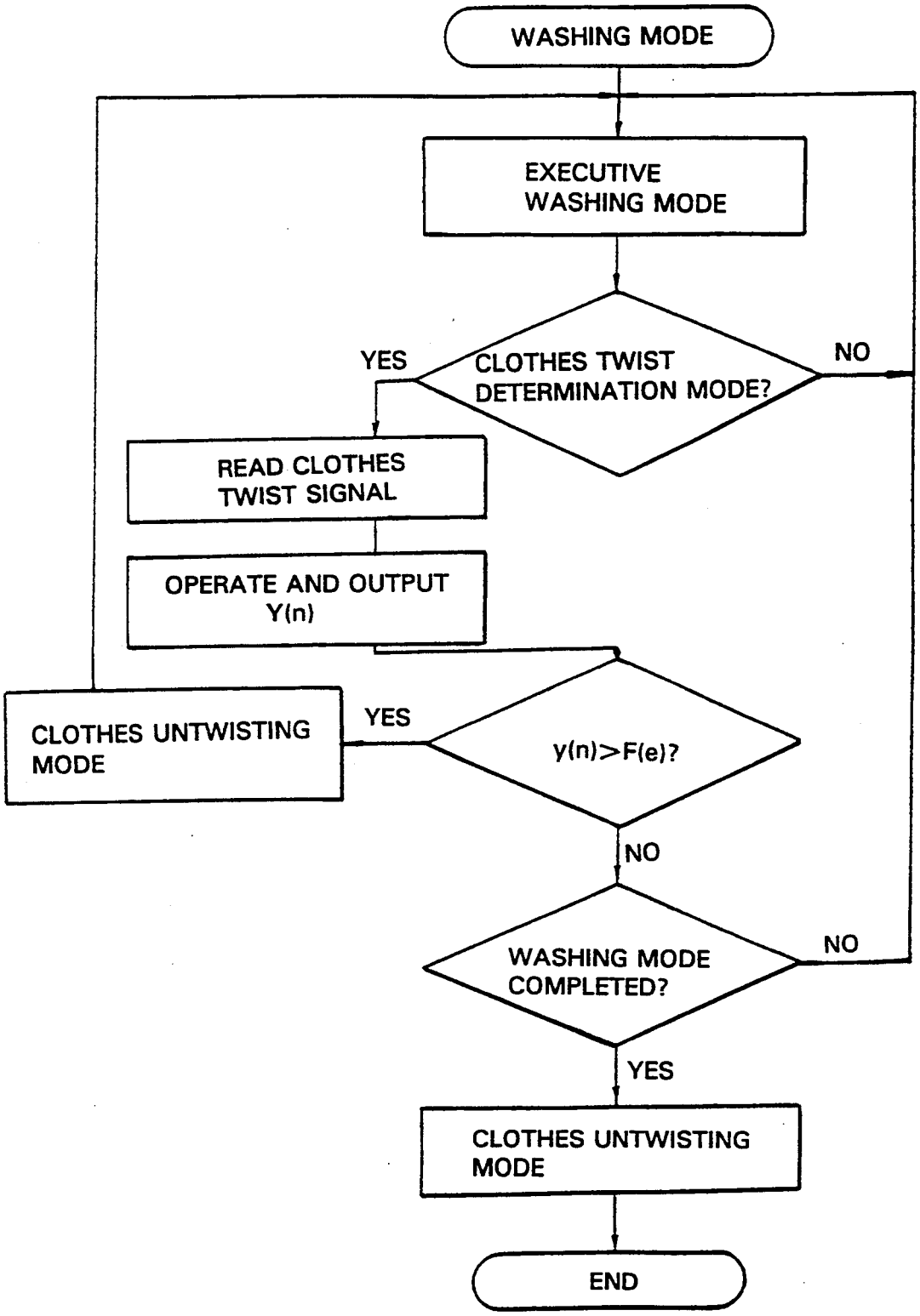
FIG. 7 is a flow chart illustrating a clothes twist determining procedure when a washing mode is executed in accordance with the first embodiment of the present invention.

FIG. 7 is a flow chart illustrating a clothes twist determining procedure when the washing mode is executed in accordance with the first embodiment of the present invention.

In accordance with the procedure, the correlation coefficient Y(n) supplied from the correlation coefficient operating unit 30 is compared with the reference value Fe of the washing mode. When the correlation coefficient Y(n) has been determined to be higher than the reference value Fe, the clothes is determined as having been twisted. Accordingly, the clothes untwisting mode is executed. On the other hand, when the correlation coefficient Y(n) is not higher than the reference value Fe, a determination is made about whether the current washing mode has been completed. When the current washing mode has been completed, the clothes untwisting mode is executed. If not, the current washing mode is continuously executed. Thus, it is possible to prevent the clothes from being twisted during the execution of the washing mode.

FIG. 8 is a flow chart illustrating a clothes twist determining procedure when the rinsing mode is executed in accordance with the first embodiment of the present invention.

In accordance with the procedure, the correlation coefficient Y(n) supplied from the correlation coefficient operating unit 30 is compared with the reference value Fi of the rinsing mode. When the correlation coefficient Y(n) has been determined to be higher than the reference value Fi, the clothes is determined as having been twisted. Accordingly, the clothes untwisting mode is executed. On the other hand, when the correlation coefficient Y(n) is not higher than the reference value Fe, a determination is made about whether the current rinsing mode has been completed. When the current rinsing mode is in progress, it is continuously executed. Thus, it is possible to prevent the clothes from twisting during the execution of the washing mode.

When the rinsing mode has been completed, the clothes untwisting mode may be executed.

Figure 9:
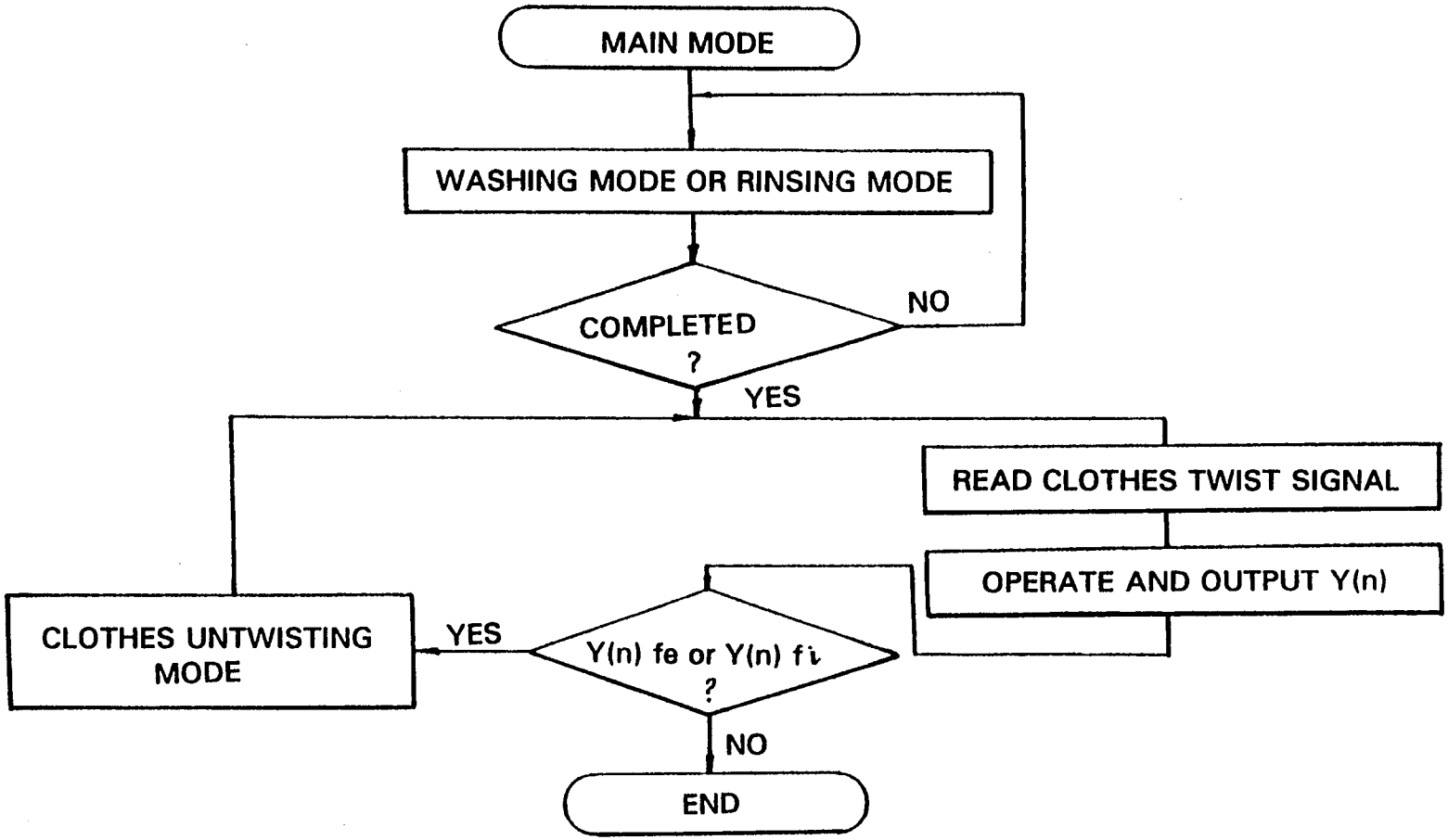
FIG. 9 is a flow chart illustrating a second embodiment of the clothes twist determining method in accordance with the present invention.

FIG. 9 is a flow chart illustrating a second embodiment of the clothes twist determining method in accordance with the present invention. In accordance with this method, first, a determination is made about whether the current mode is the washing mode or the rinsing mode, as shown in FIG. 9. Thereafter, a check is made about whether the current mode has been completed. Where the current mode has been completed, a clothes twist signal outputted from the clothes twist sensing unit 10 is then read. The clothes twist signal is then analyzed so that its correlation coefficient Y(n) is operated.

Subsequently, the correlation coefficient Y(n) supplied from the correlation coefficient operating unit 30 is compared with the reference value Fe of the washing mode or the reference value Fi of the rinsing mode. When the correlation coefficient Y(n) has been determined to be higher than the reference value Fe or Fi, the clothes is determined as having been twisted. Accordingly, the clothes untwisting mode is executed.

As apparent from the above description, the present invention provides clothes twist determining apparatus and method capable of analyzing a complex clothes twist signal generated when clothes being washed in a washer include cloths of various qualities, to determine whether the clothes twist signal is a meaningful signal, and controlling the washer according to the determined clothes twist signal when the clothes twist signal is the meaningful signal, thereby preventing the clothes from being twisted. Accordingly, it is possible to minimize a damage of clothes occurring at the twisted portion of clothes and improve the washing degree degraded at the twisted portion of clothes.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for determining a twist of clothes being washed in a washer, comprising:

clothes twist sensing means for sensing a torque occurring at a drive shaft of said washer due to the twist of clothes, to sense the distribution of impact applied to an agitator of the washer by said clothes, and generating a clothes twist signal according to the sensed impact distribution;

correlation coefficient operating means for converting said clothes twist signal into a digital signal indicative of a state value of the clothes twist signal, analyzing said state value of the clothes twist signal, and operating a correlation coefficient to be used for determining whether the clothes twist signal is a meaningful signal or a noise, based on the analysis; and a microprocessor for performing a control for executing a clothes untwisting mode, when the clothes twist signal is determined to be said meaningful signal, from said correlation coefficient outputted from said correlation coefficient operating means.

2. An apparatus in accordance with claim 1, wherein said clothes twist sensing means comprises a vibration sensor adapted to sense a vibration occurring at said drive shaft due to said impact distribution by the clothes.

3. A method of determining a twist of clothes being washed in a washer, comprising the steps of:

(a) determining whether the current mode of said washer is a washing mode or a rinsing mode;

(b) agitating said clothes normally and reversely for a predetermined time by driving a motor and an agitator equipped in the washer, sensing a torque occurring at a drive shaft of the washer due to an impact from the clothes, and generating a clothes twist signal according to the sensed torque;

(c) operating a correlation coefficient of said clothes twist signal outputted at said step (b), to determine whether the clothes twist signal is a meaningful signal or a noise; and (d) comparing said correlation coefficient outputted at said step (c) with a predetermined reference value, executing a clothes untwisting mode when the correlation coefficient is higher than said reference value, determining whether the current mode has been completed when the correlation coefficient is not higher than the reference value, and reading a clothes twist signal inputted during an execution of said washing mode when the current mode has not been completed yet.

4. A method of determining a twist of clothes being washed in a washer, comprising the steps of:

(a) determining whether the current mode of said washer is a washing mode or a rinsing mode;

(b) checking whether the current mode has been completed;

(b) agitating said clothes normally and reversely for a predetermined time by driving a motor equipped in the washer, when the current mode has been determined as having been completed at said step (b), sensing a torque occurring at a drive shaft of the washer due to an impact from the clothes, and generating a clothes twist signal according to the sensed torque;

(d) operating a correlation coefficient of said clothes twist signal outputted at said step (c), to determine whether the clothes twist signal is a meaningful signal or a noise; and (e) comparing said correlation coefficient outputted at said step (d) with a predetermined reference value, and executing a clothes untwisting mode when the correlation coefficient is higher than said reference value.

5. A method in accordance with claim 4, wherein said step (e) comprises determining whether the current mode has been completed when the correlation coefficient is not higher than the reference value, and executing an inputted mode other than the current mode when the current mode has not been completed yet.

6. A method in accordance with claim 3, wherein at said step (b), a normal rotation time and a reverse rotation time of said agitator are set to be identical to each other and to be higher than a stop time after a normal rotation of the agitator and a stop time after a reverse rotation of the agitator, respectively.

7. A method in accordance with claim 3, wherein at said step (b), a normal rotation time and a reverse rotation time of said agitator are set to be different from each other and to be higher than a stop time after a normal rotation of the agitator and a stop time after a reverse rotation of the agitator, respectively.

8. A method in accordance with claim 3, wherein said step (d) comprises:

a first step of comparing said correlation coefficient inputted during an execution of said washing mode with said reference value, when the current mode has been determined as the washing mode at said step (a);

second step of executing said clothes untwisting mode when the correlation coefficient has been determined to be higher than the reference value at said first step, and determining whether the current washing mode has been completed; and a third step of performing said second step when the current washing mode has not been completed yet, and performing said step (b) when the current washing mode has been completed.

9. A method in accordance with claim 3, wherein said step (d) comprises:

a first step of comparing said correlation coefficient inputted during an execution of said rinsing mode with said reference value, when the current mode has been determined as the rinsing mode at said step (a);

a second step of executing said clothes untwisting mode when the correlation coefficient has been determined to be higher than the reference value at said first step, and determining whether the current rinsing mode has been completed; and a third step of performing said second step when the current rinsing mode has not been completed yet, and performing said step (a) when the current rinsing mode has been completed.

* * * * *